US009861858B2

(12) United States Patent
Browning et al.

(10) Patent No.: US 9,861,858 B2
(45) **Date of Patent: *Jan. 9, 2018**

(54) MONOFIN, TAIL AND METHOD

(71) Applicant: Blue Springs Partners, LLC, Idaho Falls, ID (US)

(72) Inventors: Eric Browning, Shelley, ID (US); Steven Browning, Rigby, ID (US); Brent Houghton, Shelley, ID (US); Kyle Kinghorn, Rexburg, ID (US); Christine Dustin, Idaho Falls, ID (US)

(73) Assignee: Blue Springs Partners, LLC, Idaho Falls, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/408,246

(22) Filed: Jan. 17, 2017

(65) Prior Publication Data

US 2017/0189759 A1 Jul. 6, 2017

Related U.S. Application Data

(63) Continuation-in-part of application No. 14/854,601, filed on Sep. 15, 2015, now Pat. No. 9,604,103, which is a continuation-in-part of application No. 14/286,735, filed on May 23, 2014, now Pat. No. 9,162,110.

(51) Int. Cl.
*A63B 31/11* (2006.01)
*A63B 31/12* (2006.01)

(52) U.S. Cl.
CPC ..... *A63B 31/11* (2013.01); *A63B 31/12* (2013.01); *A63B 2209/00* (2013.01); *A63B 2209/10* (2013.01)

(58) Field of Classification Search
CPC ..... A63B 31/00; A63B 31/08; A63B 31/10; A63B 31/11; A63B 35/02; A63B 31/12
USPC ..... 441/64; 2/67
See application file for complete search history.

(56) References Cited

U.S. PATENT DOCUMENTS

| | | | |
|---|---|---|---|
| 3,344,449 | A | 10/1967 | Grilli |
| 3,934,290 | A | 1/1976 | Le Vasseur |
| 4,541,810 | A | 9/1985 | Wenzel |
| 4,781,637 | A | 11/1988 | Caires |
| 5,429,536 | A | 7/1995 | Evans |
| D379,398 | S | 5/1997 | Garraffa et al. |
| D415,544 | S | 10/1999 | Applegate |
| 6,086,440 | A | 7/2000 | Fechtner |
| 6,309,270 | B1 | 10/2001 | Harwell, IV |

(Continued)

FOREIGN PATENT DOCUMENTS

| | | |
|---|---|---|
| DE | 19934556 | 1/2001 |
| JP | 4314461 A | 11/1992 |

(Continued)

OTHER PUBLICATIONS

My Magictail Mermaid Tail youtube video: https://www.youtube.com/watch?v=aVZc3tS1Yjk.

(Continued)

*Primary Examiner* — Lars A Olson
(74) *Attorney, Agent, or Firm* — Park, Vaughan, Fleming & Dowler LLP

(57) ABSTRACT

A monofin, mermaid tail, and method of applying the tail and monofin to increase swimming efficiency and/or aesthetics.

30 Claims, 7 Drawing Sheets

(56) References Cited

U.S. PATENT DOCUMENTS

| | | | | |
|---|---|---|---|---|
| 6,375,530 | B1 | 4/2002 | Earl | |
| 6,764,362 | B1 | 7/2004 | Wenzel | |
| 8,382,542 | B2 | 2/2013 | Pakhomov | |
| D679,480 | S | 4/2013 | Geurts | |
| 8,628,365 | B2 | 1/2014 | Burdick et al. | |
| 8,632,372 | B2 | 1/2014 | Fleck | |
| 8,986,170 | B2 | 3/2015 | Sherstnev et al. | |
| 9,162,110 | B1 | 10/2015 | Browning et al. | |
| 9,604,103 | B2 * | 3/2017 | Browning | A63B 31/11 |
| 2009/0170388 | A1 | 7/2009 | Bonis | |
| 2010/0099312 | A1 | 4/2010 | Shieh | |
| 2011/0217890 | A1 | 9/2011 | Fleck | |
| 2011/0250818 | A1 | 10/2011 | Geurts | |
| 2012/0252289 | A1 | 10/2012 | Johnson | |
| 2014/0199902 | A1 | 7/2014 | Suciu | |

FOREIGN PATENT DOCUMENTS

| | | | |
|---|---|---|---|
| WO | 1992011176 | A1 | 7/1992 |
| WO | 2015178973 | A1 | 11/2015 |

OTHER PUBLICATIONS

Magictail Mermaid Gathering youtube video: https://www.youtube.com/watch?v=HjgaelVjKEc.
Putting on the Magictail Mermaid Tail youtube video—https://www.youtube.com/watch?v=xDwZZDUgVoA.
How to Put on a Magic Tail Mermaid Tail youtube video: https://www.youtube.com/watch?v=gOoie0UQaYw.
Review of My Mermaid Tail—MagicTail youtube video: https://www.youtube.com/watch?v=mfnUKB5DqX8.
Unboxing—Review MagicTail youtube video: https://www.youtube.com/watch?v=JJ4whmvQZI.
My Mermaid Tail youtube video: https://www.youtube.com/watch?v=WCVbg2GMDm4.
Lets Talk About Monofins! Finfun Mermaid and MagicTail, DE youtube video—https//www.youtube.com/watch?v=UA_baV1gTI8.
Finis Wave Monofin website: http://www.finisinc.com/Wave-Monofin.
Finis Rapid Monofin website: http://www.finisinc.com/Rapid-Monofin.
Finis Shooter Monofin website: http://http://www.finisinc.com/Shooter-Monofin-XL.
Finis Competitor Monofin website. http://www.finisinc.com/Competitor-Monofin-XL.
Finis Trainer Monofin website: http://www.finisinc.com/trainer-1-Monofin-XXL.
Finis Foil Monofin website: http://www.finisinc.com/Foil-Monofin.
Finis Mermaid Swim Fin website: http://www.finisinc.com/Mermaid-Swim-Fin.
Wikipedia; https://en.wikipedia.org/wiki/Monofin; Monotin; May 5, 2016.
Magictail: http://www.magictail.de/index.php?option=com_sebercart&view=store&ck=20&,It; design: copyright meerjungfrauenschwanzflosse 2011-2016.
Magictail—a real mermaid tail for swimming!—YouTube: https://www.youtube.com/watch?v=toWbMm6t5KI; uploaded Jul. 7, 2011.
Magictail—Magic Tail Review: YouTube: https://www.youtube.com/watch?v=QJapK1mCq0c; Published Mar. 30, 2013; Samantha fives-rush.
Mermaid Tail Review: https://www.youtube.com/watch?v=19dW8JFgurw; Published Jul. 30, 2013, MermaidTallTale.
Magical Mermaids—Making Dreams Come True: http://magicalmermaids.co.za/product/pro-mono-neoprene-replacement/; Pro Mono Neoprene Replacement; downloaded May 16, 2016.
Nov. 20, 2015 Letter from Fitzpatrick to Shaver and Swanson—Response to letter dated Nov. 18, 2015: The2Tails;—Fin Fin Mermaid; MONOFIN; Tail and Method.
Jan. 29, 2016 Letter from Miller to Swanson—Alleged Infringement of U.S. Pat. No. 9,162,110.
Feb. 29, 2016 Letter from Miller to Dowler—*Blue Spring Partners, LLC* v. *Sun Tail Mermaid LLC*, Rule 408 Communication.
Mar. 17, 2016 Letter from Fitzpatrick PC to Dowler—Response to letter dated Feb. 24, 2016; The2Tails—Blue Springs Partners, LLC MONOFIN, Tail and Method.
Mermaid Tails: website: www.mermaidtails.net.
Aqua Tails: website: www.aquatails.com.
Mermagica: website: www.mermagica.com.
Metro Swim Shop website: www.metroswimshop.com/product.Finis%20Wave.htm#.U0cNqtJOWcw.
Miami Beach Mermaids website: http://miamibeachmermaids.com/#!mermaid-store/c1sn6.
The Mertailor website: https://www.themertailor.com/mermaid-monofin-flipper?search=flipper.
Lumugdano, Abigael T. "Explore the mythical world of fitness through mermaid swimming" Health & Fitness, Apr. 13, 2014.
Monofin, website: monofin.org/monofin-beginner.htm.
Mermaid Fin website: http://www.mermaidfin.com/.
Fin Fun Mermaid—How to use a Fin Fun Monofin. YouTube. Feb. 15, 2014 [retrieved on Apr. 14, 2015]. Retrieved from Internet: <URL:https://www.youtube.com/watch?v=TnJO7ch37js>, entire video.
Australian Government: IP Australia—Innovation Patent Examination Report No. 1. Patent Application No. 2015100165, Blue Spring Partners LLC Apr. 16, 2015.
PCT International Search Report and Written Opinion, PCT/US2015/015565, Blue Spring Partners, LLC, dated May 18, 2015.
Fin Fun Mermaid, All about our Mermail Monofins, Jun. 18, 2013.
Mermaid tail swimming apparatus sold by Magictail GmbH (photos).
Sun Tail: photos of product available in 2010.

* cited by examiner

MONOFIN, TAIL AND METHOD

The present application is a continuation-in-part of, and hereby claims priority under 35 U.S.C. §120 to, U.S. patent application Ser. No. 14/854,601, which was filed 15 Sep. 2015, and is incorporated herein by reference. U.S. patent application Ser. No. 14/854,601 is a continuation-in-part of, and hereby claims priority under 35 U.S.C. §120 to, U.S. patent application Ser. No. 14/286,735, which was filed 23 May 2014, now Issued U.S. Pat. No. 9,162,110, by the same inventors, the contents of which are herein incorporated by reference in their entirety for all purposes.

TECHNICAL FIELD

The presently disclosed and claimed inventive concepts generally relate to an apparatus for swimming, and more particularly to a monofin and mermaid tail.

BACKGROUND

Swimming is a popular activity among millions of people every year. It is not uncommon to see a swimmer keep their feet together and swim in a style similar to a mermaid or a dolphin. This provides a different exercise as well as additional enjoyment for the swimmer.

In order to improve the ability of a swimmer to mimic a mermaid while swimming, several monofins have been developed which increase the propulsion force of a user's feet while swimming in the mermaid style. A monofin keeps both of a user's feet connected to a single fin, while having a large flat surface extending away from the user's feet. To secure the monofin to the user's feet, heel straps have been utilized. The heel straps, however, have a tendency to slide off of the user's heel once they are wet and the user places force on them during use. The monofins and heel straps have generally been constructed out of rubber or hard plastic.

Both of these construction practices result in a monofin that is uncomfortable to a user due to the abrasive nature of rubber or plastic that contacts a user's skin. It is desirable to produce a monofin that is more comfortable for a user. Unfortunately, in order to achieve the desired comfort it has been necessary to use materials that are not as hard or stiff as the rubber or hard plastic for connecting the user's feet to the monofin. This causes a significant loss in efficiency of the swimming stroke and enjoyment for the user. It is also desirable to allow users to have the appearance of a mermaid. While this appearance has been done before, the prior art has been limited to mainly performance driven designs, with poor comfort features.

SUMMARY

Disclosed is a swimming device in the shape of a monofin similar to a mermaid fin that allows a user's feet to function similar to a mermaid tail or dolphin tail fin. The shape of the device is created by a resilient member that is flat and elongate and has a first side, a second side, a third side, a fourth side, a first end, and a second end. The sides are preferably curved and the second end is preferably concave in order to mimic the appearance of the trailing edge of a mermaid tail fin. The first end is the general location of the foot retainers.

The resilient member is enclosed by a cover. In a preferred embodiment, the cover is made from neoprene and the resilient member is made from polycarbonate, but other materials are acceptable. For example, the cover could be made of spandex or other elastic material while the resilient member may be made of a different plastic or rubber. The cover has a first edge, a second edge, a third edge, and a fourth edge, so that in one embodiment when placed around the resilient member, the edges of the cover are adjacent to the sides of the resilient member. The sides of the cover combine to make a periphery that extends around the resilient member in order to substantially enclose it. In another embodiment, the cover can substantially enclose or surround the resilient member in the sense that a rubber band on a tennis ball substantially surrounds the tennis ball. In other words, in this embodiment, some portions of the resilient member can stick out from the cover. The cover can be held in place using various methods including adhesive or hook and loop closures, with stitching around the periphery being a preferred embodiment.

Attached to the cover are one or more foot retainers. These retainers secure the device to the user's feet in order to allow a user to swim in a motion similar to a mermaid without the swimming device coming off. The foot retainer can be made using one or more straps to secure the user's feet to the monofin. In a preferred embodiment, the foot retainer is comprised of sock-like retainers extending underneath the top half of the cover. The sock-like retainers are elastic, allowing for a snug and secure fit with a variety of foot sizes. One or more securing cords also can be present, with one optionally being located between or near the position of the user's feet. The securing cord is attached to or through the resilient member, and has a sliding lock that can be pressed toward the top surface of the resilient member to press and hold the cover against the resilient member. This provides a more secure foot retention ability.

In one embodiment, the securing cord can be attached to the resilient member in a number of different ways. The securing cord can pass through the resilient member and be secured by a plate on the underside of the resilient member, the plate can be embedded inside the resilient member, or attached to the resilient member with an eyebolt, or an equivalent structure.

Further disclosed is a method for applying a mermaid tail. A first step is placing a tubular fabric mermaid tail, having a waist section, a leg section, and a tail section, around a user's legs. The second step is for the waist section of the mermaid tail to be placed around the user's waist. The third step is pulling the tail section above a user's feet, thereby exposing the user's feet. The fourth step is placing a swimming device, a monofin, on the user's feet. The monofin is designed to create a single fin whereon each of a user's feet is attached. In an embodiment employing a securing cord, the fifth step is to tighten the securing cord described above to more positively secure the users feet to the monofin. The sixth step is to pull the tail section down over the monofin, thereby covering the monofin to create the appearance of a continuous fin and tail.

In yet another embodiment, the strength and/or wear resistance of one or more regions of the fabric tail and/or cover for the resilient member are enhanced, which can be achieved by a number of techniques, including dipping or otherwise coating the region using a strengthening material such as Plasti Dip. Strengthening such area(s) can increase the useful lifetime of the fabric/cover and swimming device in general, especially if applied to areas of the device that tend to wear before other areas, such as the tips and/or heel of the device.

DETAILED DESCRIPTION OF THE EXEMPLARY EMBODIMENTS

Figure 1:
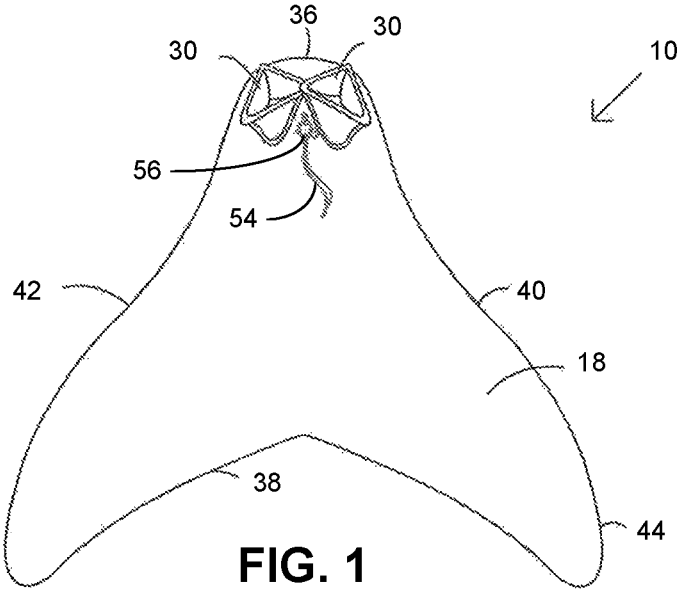
FIG. 1 is a top view of a monofin in accordance with an embodiment of the inventive concepts.
Figure 2:
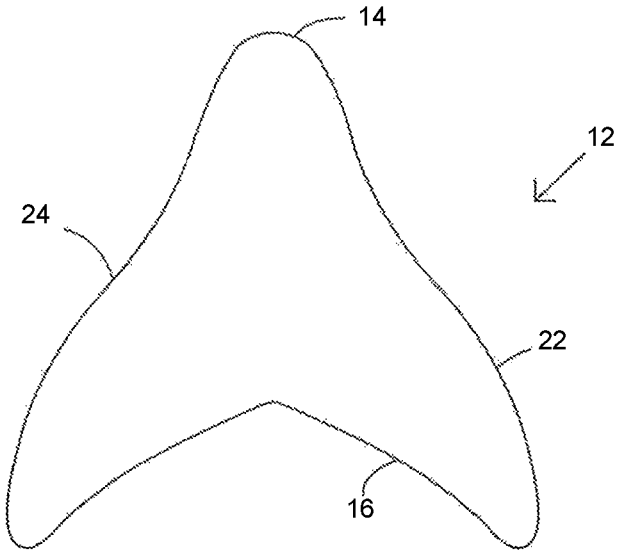
FIG. 2 is a top view of a resilient member in accordance with an embodiment of the inventive concepts.
Figure 3:
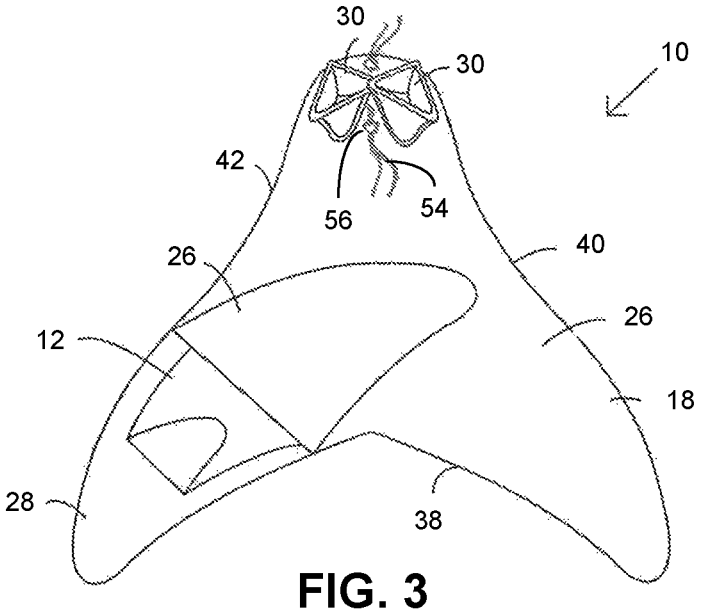
FIG. 3 is a top view of a monofin in accordance with an embodiment of the inventive concepts, wherein the cover is folded open to show the interior resilient member.

FIG. 1 shows a top view of one embodiment of swimming device 10. In this embodiment, swimming device 10 includes a cover 18 having a cover first edge 36, a cover second edge 38, a cover third edge 40, and a cover fourth edge 42. Combined, these four edges form the periphery 44 of the cover 18. Swimming device 10 is attachable to a user's feet using foot retainers 30. FIG. 1 shows foot retainer 30 as two separate holes that pass into the swimming device 10 in order to secure both user's feet therein. Foot retainer 30 is made of two separate sock-like structures. Each sock-like structure extends into cover 18. Further, foot retainer 30 is made of an elastic material, preferably a four-way stretch polyester and nylon blend, but other materials would also work, such as spandex and nylon blend or neoprene, that allows for a snug fit with a wide range of foot sizes. The elastic material also allows for easy removal of swimming device 10. A user simply has to slide a finger or thumb down the heel behind the foot and the heel will come free from the foot retainer 30. In a preferred embodiment, the foot retainers 30 extend into cover 18 but do not pass through flexible member 12, which is not shown in FIG. 1 but is shown in FIGS. 2-3. While the system shown is preferred, other foot retainers are foreseeable, including straps and laces.

FIG. 1 also shows swimming device 10 having the cover first edge 36, cover second edge 38, cover third 40 edge, and cover fourth edge 42 curved in order to mimic a mermaid or dolphin fin. While this embodiment is preferred, it is possible to have the edges straight or curved in other shapes or a combination of straight and curved edges.

In another embodiment, and in order to maintain shape and provide rigidity to the swimming device 10, a resilient member 12, which is not shown in FIG. 1 (but see FIGS. 2-3), is positioned inside of cover 18. The preferred material for cover 18 of swimming device 10 is neoprene because neoprene is soft, meant for use in water, and not very absorbent. Nevertheless, additional materials, including spandex and polyester, could be used. The size of the swimming device 10 can vary widely based on personal performance and aesthetics, but a general circumference of 76 inches works well for adults, with a circumference of 62 inches being preferred for many children. A size for children and a size for adults is preferred, with the child size 40% smaller than the size for adults.

Figure 11:
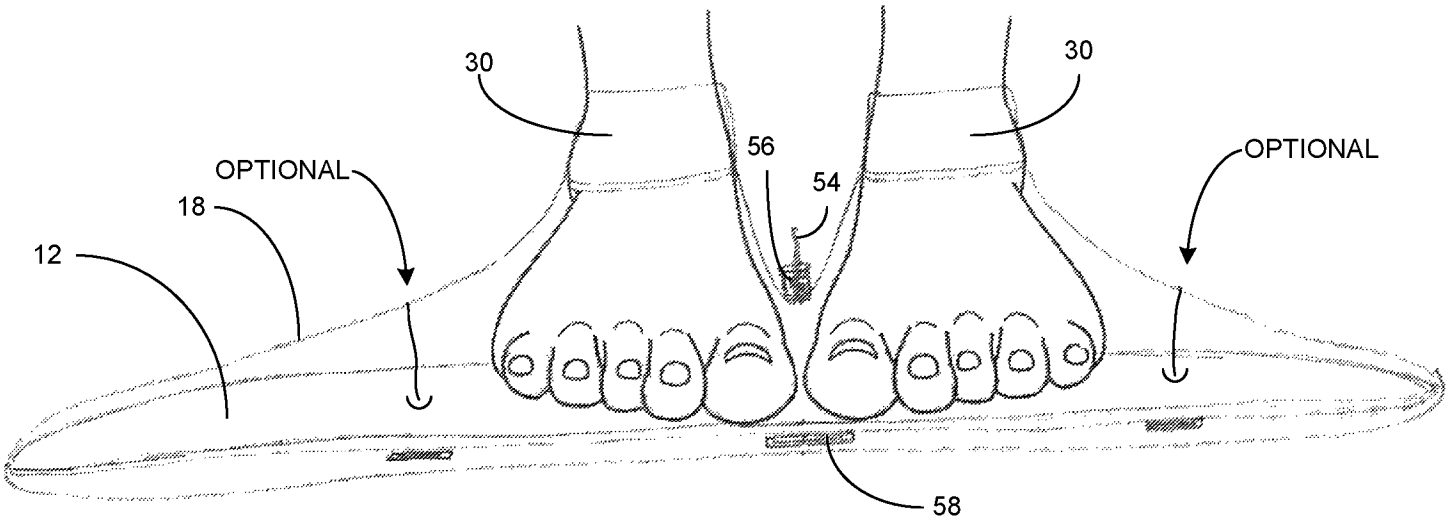
FIG. 11 is a front view of a monofin showing the position of a user's feet and securing cords.

FIG. 1 also shows a securing cord 54 and a cord lock 56. In this embodiment, the cord 54 extends through the resilient member 12 and is secured by an anchor 58, which can be a flat dish shape, and serves the purpose of securing one end of the cord 54 to the resilient member. The securing cord 54, the cord lock 56, and the anchor 58 are shown in more detail in FIG. 11. Shown in FIG. 11 are alternate positions of additional securing cords. A preferred locking cord is the Sporti Bungee Cord with a cord lock, while similar cords and locks would also work. A preferred position for placing at least one securing cord and lock is between the user's feet.

In one embodiment, the cover may expose one or more wear surfaces, such as the tips and/or heel, of the resilient member to eliminate wear on the cover at those regions. In another embodiment, such wear surfaces of the cover may be covered with an additional layer of wear resistant material (as further described below). The cover and/or wear surfaces of the cover may also be made of a more wear resistant material than neoprene, such as nylon, Kevlar, canvas, hypalon, PVC, or other strong and wear resistant materials.

Figure 12:
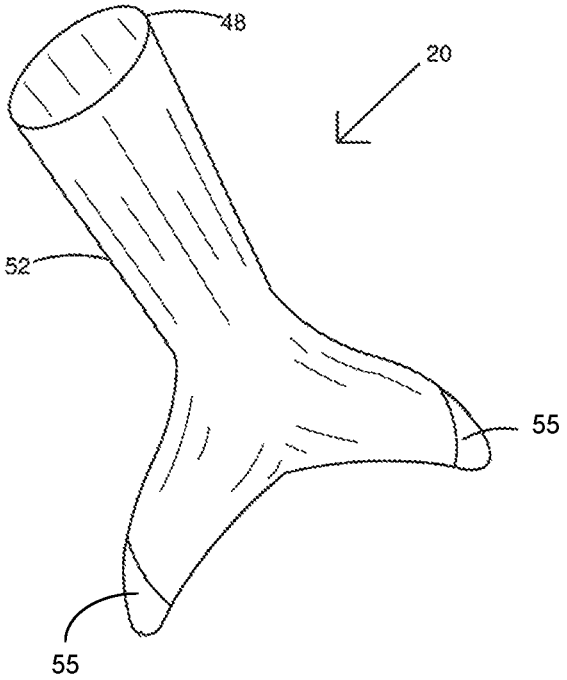
FIG. 12 is a top view of a mermaid tail in accordance with an embodiment of the inventive concepts.

In yet another embodiment, the strength and/or wear resistance of one or more regions of the cover for the resilient member and/or the fabric tail are enhanced, which can be achieved by a number of techniques, including dipping or otherwise coating the region using a strengthening material such as Plasti Dip. Strengthening such area(s) can increase the useful lifetime of the fabric and swimming device in general, especially if applied to areas of the device that tend to wear before other areas, such as the tips and/or heel of the cover for the resilient member and/or those same areas on the fabric tail. An example of one such embodiment is illustrated in FIG. 12, showing coated tips 55 of the fabric tail. As indicated, however, these coatings could also be made to the heel of the fabric tail, as well as to the tips and/or heel of the cover for the resilient member.

Still further, one configuration of the various above-described embodiments is to have two or three securing cords but only one tightening lock. One cord could be attached to the neoprene cover on the outside of the foot and then run through the resilient member, then underneath and across to the middle of the member, and finally up through a hole and through the cover between the feet. A second cord would do the same thing on the other side. Both cords would pull through a single tightening lock. A third (optional) cord would be positioned between the feet and attached to the neoprene cover and secured to the resilient member. In this embodiment, with a single pull, a user can draw the cords tight and secure the neoprene from the left, center, and right positions.

FIG. 2 shows resilient member 12 prior to being placed within cover 18. As shown in this particular embodiment, it is preferable for resilient member 12 and cover 18 to have similar shapes and sizes. However, modifications are possible in order to achieve various aesthetic and performance goals. Further, various thicknesses and materials can be used to obtain different stiffness. For example, making resilient member 12 thin and flexible will allow for easier movement in the water, while making resilient member 12 thicker and less flexible will allow a stronger user to generate more propulsion force. The resilient member 12 is preferably (but not necessarily) removable from within cover 18. The ability to remove resilient member 12 allows the user to change resilient members for different users without the need to buy an entirely new swimming device 10. For instance, a stronger swimmer would be able to use a less flexible version of resilient member 12, while a weaker swimmer could switch in a more flexible version of resilient member 12. This also allows the swimming device 10 to be changed as a user improves his or her strength. In a preferred embodiment, the resilient member 12 is 0.08 inches thick and made from polycarbonate. Other materials are possible such as other plastics, rubber, foam, or wood with different dimensions possible for each material. The preferred combination of a resilient member 12 made of polycarbonate and cover 18 made of neoprene yields results where the swimming device 10 is lightweight and feels nearly weightless in the water. The resilient member 12 is approximately neutral in buoyancy.

Shown in FIG. 2, resilient member 12 has a first side 14 located where a user's feet will be during use. Resilient member 12 further includes a second side 16, which operates to provide propulsion during use. Third side 22 and fourth side 24 of resilient member 12 are curved in order to improve performance as well as to mimic the shape of a Mermaid or Dolphin tail fin. Cover second edge 38 corresponds to resilient member second side, while cover third edge 40 and cover fourth edge 42 correspond to resilient member third side and resilient member fourth side, respectively.

FIG. 3 shows the resilient member 12 located between a cover top half 26 and cover bottom half 28. The cover top half 26 has been partially folded back to show resilient member 12, which is also partially folded back. Once cover top half 26 and cover bottom half 28 are secured, this configuration prevents resilient member 12 from separating from the cover 18 while providing rigidity to the swimming device 10.

Figure 4:
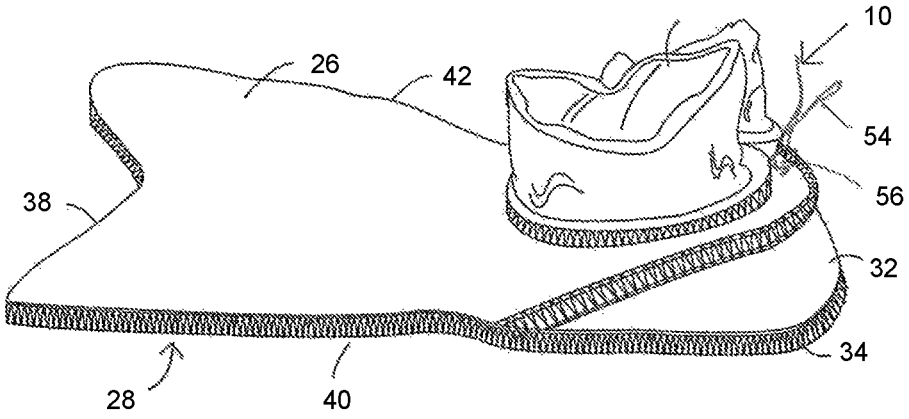
FIG. 4 is a perspective view of the side of a monofin in accordance with an embodiment of the inventive concepts.

FIG. 4 shows an exemplary embodiment of cover first edge 36 having a rear side 32. Rear side 32 provides room for a user's heel so that the user's feet can be positioned in between cover top half 26 and resilient member 12, while the user's heel is secured by the rear side 32. Also shown in FIG. 4 is a preferred design of securing cover top half 26 and cover bottom half 28 around resilient member 12. The design shown utilizes stitching 34 around the periphery 44 of the cover 18 in order to attach the cover top half 26 and cover bottom half 28 around resilient member 12. Other possibilities for securing the cover 18 around the resilient member 12 include the use of adhesives, the use of lacing, hook and loop fasteners, buttons, a combination thereof, or other mechanisms.

Figure 5:
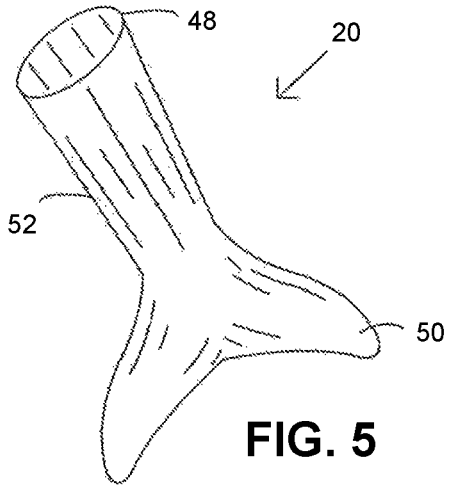
FIG. 5 is a perspective view of a mermaid tail in accordance with an embodiment of the inventive concepts.

FIG. 5 shows an embodiment of a mermaid tail 20. The mermaid tail 20 is tubular and features a leg section 52 that surrounds a user's legs, a waist section 48 that holds the tail around a user's waist, and a tail section 50 that fits around swimming device 10, not shown in FIG. 5. Waist section 48 fits around a user's waist to hold mermaid tail 20 in an appropriate place. Waist section 48 can include other features, such as tacky rubber, to decrease the risk of the mermaid tail 20 sliding on the user. Leg section 52 is attached to waist section 48. Leg section 52 fits around a user's legs tight enough to hold itself in place. Shown in FIG. 5, mermaid tail 20 includes tail section 50 connected to leg section 52. In a preferred embodiment, waist section 48, leg section 52, and tail section 50 are made from a single piece of elastic material. Tail section 50 is preferably large enough to extend over a swimming device 10. Extending tail section 50 over swimming device 10 allows the mermaid tail 20 to have a continuous appearance on the user instead of a discontinuous appearance where the swimming device 10 is exposed, creating a joint between the two surfaces.

Figure 6:
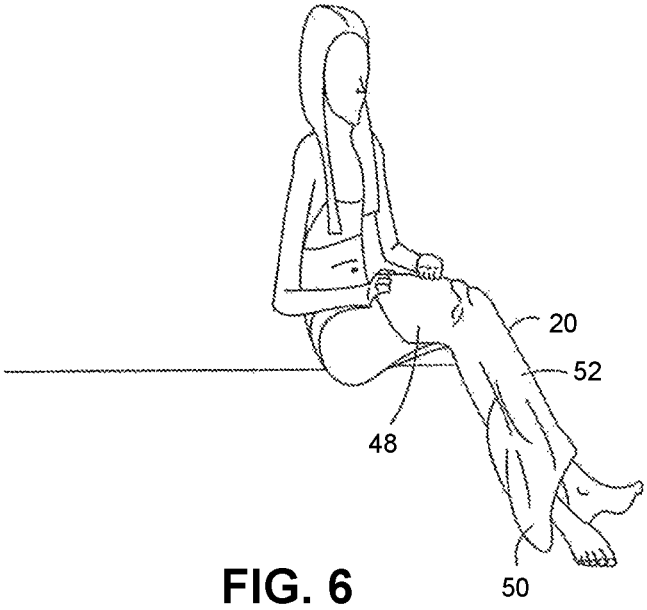
FIG. 6 is a perspective view of a user applying a mermaid tail in accordance with an embodiment of the inventive concepts.
Figure 7:
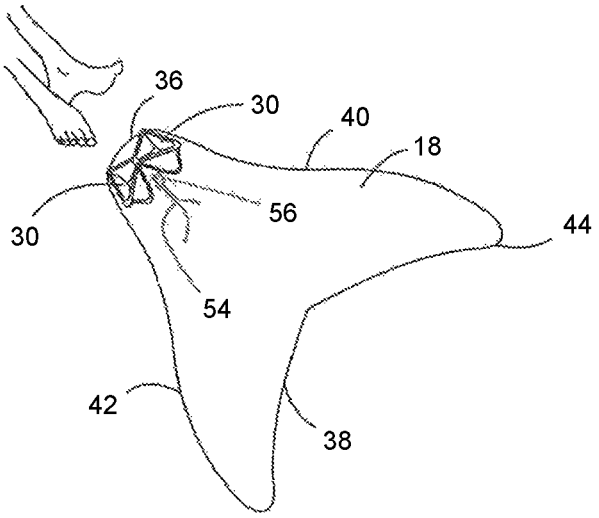
FIG. 7 is a perspective view of a user applying a monofin after applying a mermaid tail in accordance with an embodiment of the inventive concepts.
Figure 8:
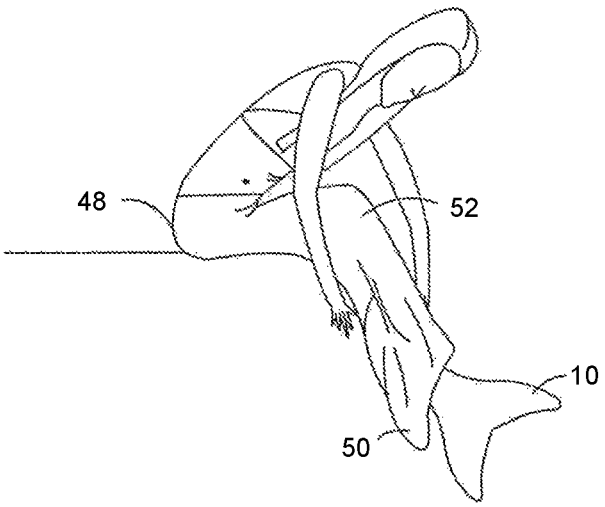
FIG. 8 is a perspective view of a user pulling a tail section of a mermaid tail over a monofin in accordance with an embodiment of the inventive concepts.
Figure 9:
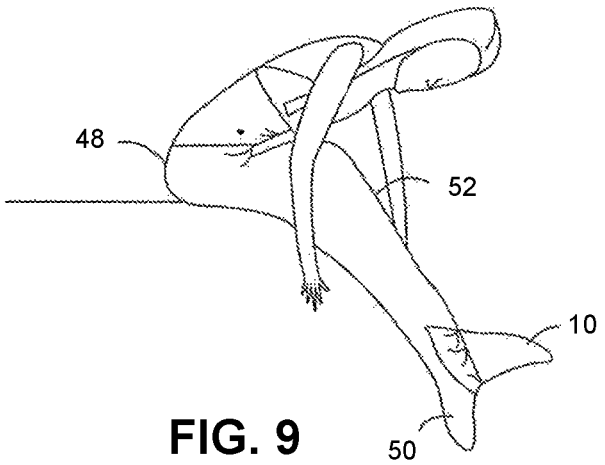
FIG. 9 is a perspective view of a user pulling a tail section of a mermaid tail over a monofin in accordance with an embodiment of the inventive concepts.
Figure 10:
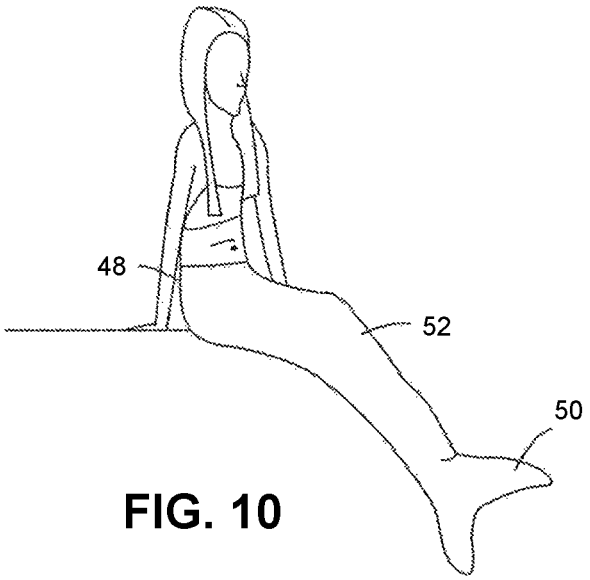
FIG. 10 is a perspective view of a user having applied a mermaid tail in accordance with an embodiment of the inventive concepts.

Also disclosed is a method of applying a mermaid tail 20 to create the appearance that the user is a mermaid. FIG. 6 shows step one of the method, placing the mermaid tail around both legs of a user. In a preferred embodiment, this is done by sliding the waist section 48 over a user's feet and further sliding the leg section 52 and tail section 50 over the user's feet. As one alternative, the mermaid tail 20 can be rolled over a user's legs if the mermaid tail 20 is previously rolled. Step two, also shown in FIG. 6, is pulling the waist section 48 to a user's waist. Preferably this is done by sliding waist section 48 until waist section 48 is correctly placed. While sliding waist section 48, the leg section 52 extends to cover a user's legs. Step three, shown in FIG. 7, is to expose the user's feet through the tail section 50. This allows a user to complete step four, which is attaching swimming device 10 to the user's feet. While different designs of swimming device 10 are possible, in a preferred embodiment swimming device 10 has individual foot retainers 30 for each of a user's feet and extends away from the user's feet in a mermaid tail fin shape. Step five, shown in FIGS. 8 and 9, is pulling tail section 50 over the swimming device 10 and securing it in place. Upon pulling tail section 50 over the swimming device 10, and the waist section 48 remains at the user's waist, the user appears to have a mermaid tail and is capable of swimming in a fashion similar to a mermaid, as shown in FIG. 10.

While certain exemplary embodiments are shown in the figures and described in this disclosure, it is to be distinctly understood that the presently disclosed inventive concepts are not limited thereto but may be variously embodied to practice within the scope of the following claims. From the foregoing description, it will be apparent that various changes may be made without departing from the spirit and scope of the disclosure as defined by the following claims.

We claim:

1. A swimming device, comprising:

a resilient member having a first side, a second side, a third side, and a fourth side;

a cover having a first edge, a second edge, a third edge, and a fourth edge corresponding respectively to the first side, second side, third side, and fourth side of the resilient member, said cover covering at least a portion of the first side, second side, third side, and fourth side of the resilient member, and said cover also having at least one region more wear resistant than other regions; and at least one foot retainer attached to or formed by the cover and capable of receiving a user's foot, said foot retainer located near the first edge of the cover so that the resilient member extends under and beyond a user's foot.

2. The swimming device of claim 1 wherein the cover has a top half and a bottom half that respectively cover at least a portion of a top half of the resilient member and at least a portion of a bottom half of the resilient member.

3. The swimming device of claim 2 wherein the cover is releasably affixed to the resilient member.

4. The swimming device of claim 2 wherein the cover further comprises a rear side positioned adjacent to the first side of the resilient member, said rear side having a height configured to enclose a user's heel.

5. The swimming device of claim 2 wherein the resilient member is a monofin.

6. The swimming device of claim 2 wherein each foot retainer includes a hole formed in the cover for receiving a user's foot.

7. The swimming device of claim 2 wherein each foot retainer includes a sock structure for receiving a user's foot.

8. The swimming device of claim 2 further comprising one or more cords for securing the cover to the resilient member.

9. The swimming device of claim 2 further comprising:

a mermaid tail configured to slide over a user's feet;

the mermaid tail having a leg section, a waist section, and a tail section;

the leg section being generally tubular and attached to the waist section so that a user's feet can pass through the waist section and through the leg section; and the tail section attached to the leg section so that a user's feet can pass through the leg section and into the tail section.

10. The swimming device of claim 9 wherein the tail section is configured to extend over the resilient member.

11. The swimming device of claim 9 wherein the tail section has an open configuration so that a user's feet can extend through the tail section and so the tail section can be wrapped over the resilient member.

12. The swimming device of claim 1 wherein the at least one region of the cover is located at one or more tips of the cover.

13. The swimming device of claim 1 wherein the at least one region of the cover is located at a heel of the cover.

14. The swimming device of claim 1 wherein the at least one region of the cover is made more wear resistant by a coating of strengthening material.

15. A mermaid tail, comprising a fabric having a waist section, a leg section, and a tail section, where the tail section includes at least one region more wear resistant than other regions;

the leg section being generally tubular and attached to the waist section so that a user's feet can pass through the waist section and through the leg section; and the tail section attached to the leg section so that a user's feet can pass through the leg section and into the tail section.

16. The mermaid tail of claim 15 wherein the at least one region of the tail section is located at one or more tips of the tail section.

17. The mermaid tail of claim 16 wherein the at least one region of the tail section is made more wear resistant by a coating of strengthening material.

18. The mermaid tail of claim 17 wherein the tail section is configured to extend over a resilient member.

19. A swimming device, comprising:

a resilient member having a first side, a second side, a third side, and a fourth side;

a cover having a first edge, a second edge, a third edge, and a fourth edge corresponding respectively to the first side, second side, third side, and fourth side of the resilient member, said cover covering at least a portion of the first side, second side, third side, and fourth side of the resilient member;

at least one foot retainer attached to or formed by the cover and capable of receiving a user's foot;

a fabric having a waist section, a leg section, and a tail section, where the tail section includes at least one region more wear resistant than other regions;

the leg section being generally tubular and attached to the waist section so that a user's feet can pass through the waist section and through the leg section; and the tail section attached to the leg section so that a user's feet can pass through the leg section and into the tail section.

20. The swimming device of claim 19 wherein the cover has a top half and a bottom half that respectively cover at least a portion of a top half of the resilient member and at least a portion of a bottom half of the resilient member.

21. The swimming device of claim 20 wherein the cover is releasably affixed to the resilient member.

22. The swimming device of claim 20 wherein the cover further comprises a rear side positioned adjacent to the first side of the resilient member, said rear side having a height configured to enclose a user's heel.

23. The swimming device of claim 20 wherein the resilient member is a monofin.

24. The swimming device of claim 20 wherein each foot retainer includes a hole formed in the cover for receiving a user's foot.

25. The swimming device of claim 20 wherein each foot retainer includes a sock structure for receiving a user's foot.

26. The swimming device of claim 20 further comprising one or more cords for securing the cover to the resilient member.

27. The swimming device of claim 20 wherein the tail section is configured to extend over the resilient member.

28. The swimming device of claim 20 wherein the at least one region of the tail section is located at one or more tips of the tail.

29. The swimming device of claim 20 wherein the at least one region of the tail section is located at a heel of the tail.

30. The swimming device of claim 20 wherein the at least one region of the tail section is made more wear resistant by a coating of strengthening material.

* * * * *